US007329026B1

(12) United States Patent
Hayman et al.

(10) Patent No.: US 7,329,026 B1
(45) Date of Patent: Feb. 12, 2008

(54) LIGHTING FIXTURE WITH SMOOTH ADJUSTABLE BEAM WIDTH

(76) Inventors: Jeffery John Hayman, 15 Emerson Place, St. Albert, AB (CA) T8N 5X3; Jeremy Joseph Macgilvray, Box 50, Site 8, RR1, Calahoo, AB (CA) T0G 0J0

( * ) Notice: Subject to any disclaimer, the term of this patent is extended or adjusted under 35 U.S.C. 154(b) by 0 days.

(21) Appl. No.: 11/598,279

(22) Filed: Nov. 13, 2006

(51) Int. Cl.
*F21S 8/00* (2006.01)
*F21V 19/02* (2006.01)
*F21V 7/00* (2006.01)

(52) U.S. Cl. ..... 362/277; 362/257; 362/285; 362/297; 362/346

(58) Field of Classification Search ..... 362/232, 362/145, 147, 148, 150, 217, 220, 227, 238, 362/239, 250, 297, 404, 406, 277, 287, 219, 362/223, 225, 235, 236, 237, 240–247, 249, 362/260, 269, 299, 300, 306, 307, 311, 341, 362/346, 347, 362, 364, 365, 408, 418, 428, 362/257, 285
See application file for complete search history.

(56) References Cited

U.S. PATENT DOCUMENTS 2,232,499 A * 2/1941 Waterbury ..... 362/225
2,288,941 A * 7/1942 Curtis ..... 362/375
2,330,484 A * 9/1943 Finazzo ..... 362/33
2,339,100 A * 1/1944 Netting ..... 362/219
2,886,699 A * 5/1959 Harling ..... 362/223
3,538,324 A * 11/1970 Hankins ..... 362/277
6,382,817 B1 * 5/2002 Chelf ..... 362/322

* cited by examiner

*Primary Examiner*—Jong-Suk (James) Lee
*Assistant Examiner*—Edmund C Kang
(74) *Attorney, Agent, or Firm*—Charles Bickoff

(57) ABSTRACT

A lighting fixture having a main housing to which is attached a moveable reflector assembly. The fluorescent lamps are affixed to the main housing and the moveable reflector assembly is adjusted to a position close to the fluorescent lamps to achieve a narrow illumination field. Adjusting the position of the moveable reflector assembly away from the fluorescent lamps achieves a wide illumination field. The reflector is designed as a near parabolic like shape and may be configured as a single fluorescent lamp cavity, or a multiple lamp cavity wherein the parabolic like shapes for each fluorescent lamp intersect to provide a uniform illumination light field and highly efficient light output while minimizing the lighting fixture width.

19 Claims, 8 Drawing Sheets

LIGHTING FIXTURE WITH SMOOTH ADJUSTABLE BEAM WIDTH

CROSS-REFERENCES TO RELATED APPLICATIONS

Not Applicable

STATEMENT REGARDING FEDERALLY SPONSORED RESEARCH OR DEVELOPMENT

Not Applicable

MICROFICHE APPENDIX

Not Applicable

BACKGROUND OF THE INVENTION

1. Field of the Invention

The present invention pertains to the field of Lighting Fixtures and more particularly to a fluorescent lighting fixture having an adjustable beam pattern.

2. Prior Art

Most current fluorescent lighting fixtures have a fixed lighting pattern. That is, the lamps and reflector direct and concentrate the light to focus on a fixed area, thereby limiting the installation flexibility. The lighting fixtures create a situation wherein, in many cases, the application area either is over or under illuminated. The present invention resolves this limitation through providing a means to smoothly transition between a very wide to very narrow illumination distribution pattern.

An additional issue is that existing lighting fixtures are frequently limited to static direct or indirect lighting, or a mixture of both. Direct lighting provides illumination below the plane of the lighting fixture whereas indirect lighting provides illumination above the plane of the lighting fixture. The present invention also provides a method to mix adjustable direct with adjustable indirect lighting as suitable with the particular installation to give the most pleasing lighting effect.

A further issue is that the addition of more lamps to the fixture, to increase lighting intensity while maintaining high efficiency, causes an increase in width of the lighting fixture, which may become large enough that fitting it into the available space may be problematical. The present invention resolves this issue by placing two lamps into each special optically designed cavity to provide a smooth lighting distribution while maintaining high efficiency unavailable with simple bend single cavity per lamp reflectors.

Most fluorescent lighting fixtures in the marketplace make installation difficult in that removal of the reflector may be required to access the lamp socket wiring. Additionally, the installer is required to work over his head through the bottom of the fixture to access the ballasts and wire the fixture to power or to another fixture. The present invention resolves these issues by making the socket tray accessible without removing the reflector and placing access to the ballasts and wiring from the top, which is safer and easier from a human factors standpoint.

Additionally, the prior art generally does not provide for a choice of mounting means within a singular design. The present invention provides for several common mounting methods as accessories to meet the needs of the specific application. Tandem mounting, classical chain hangers, and flush mounting methods are incorporated into the design.

BRIEF SUMMARY OF THE INVENTION

The invention herein described is for a fluorescent lighting fixture with a smooth transition adjustable lighting pattern. The lighting pattern can be adjusted from a wide to narrow illumination field. This adjustment is accomplished by two (2) screws, one on each end, to move the reflector away from the fluorescent lamps to widen the illumination field and toward the lamps to narrow the illumination field. Increments are printed on four (4) corners of the ballast chassis such that the installer can see and adjust to the exact pattern desired. Once the field width has been adjusted, the position is fixed by means of a locking device. The reflector is designed to accommodate two (2) lamps per cavity while providing a pleasing lighting pattern and maintaining high efficiency of light output. The advantage of placing 2 lamps per cavity yields a fixture that is narrower than the equivalent competitive fixture, which has one lamp per cavity. The present invention can be configured in multiples of two (2) lamps, and is presently envisioned as a fixture containing 2, 4, or 6 lamps. It will be recognized that the present invention may also be configured with odd numbers of lamps. Furthermore it may be configured as a lighting fixture with a reflector designed to hold a single lamp.

Additionally, the lighting fixture can be configured as direct lighting or mixed direct and indirect lighting to provide the desired illumination effect. This is accomplished by fully removing or turning one or more aperture covers 180 degrees, or a mixture of both methods to expose an aperture opening that allows the desired amount of light to be directed upward as opposed to being reflected downward. There is one aperture cover per lamp.

The lighting fixture can be mounted in a tandem fashion and may be affixed to one another with appropriate hardware. Double knockouts are provided on the end panels of each fixture to provide conduit entry or to easily facilitate inter-fixture wiring when mounted in the tandem arrangement.

Access to ballasts and wiring to power is accomplished from the top of the fixture to promote ease of installation and maintenance. It is highly desirable to work from above the fixture as this allows easier visibility, is less tiring and causes less strain on the installer. In addition, the lamp sockets and their wiring can be accessed and maintained without disassembling the lighting fixture.

DESCRIPTION OF THE PREFERRED EMBODIMENTS

Figures 1, 2:
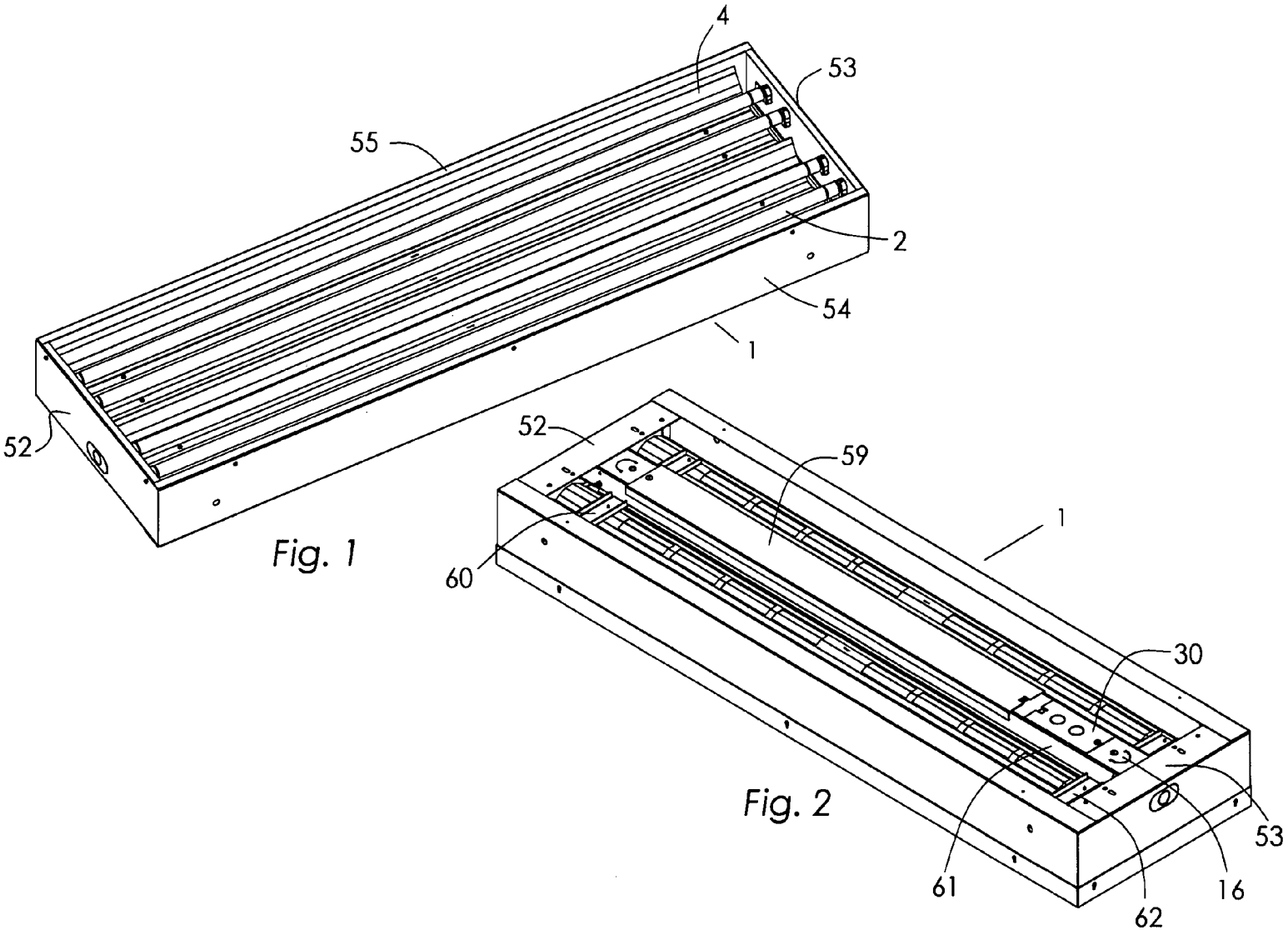
FIG. 1 is a perspective view from the bottom, lamp side, of the lighting fixture.
FIG. 2 is a perspective view from the top, ballast side, of the lighting fixture.

An overall view of the present invention is shown in FIGS. 1 and 2. FIG. 1 shows the lighting fixture 1 from the bottom, lamp side with the lens and lens mounting kit removed. FIG. 2 shows the lighting fixture from the top. The lamp fixture housing is formed from a pair of end caps 52 and 53 and a pair of side rails 54 and 55 to form the outside periphery of the lighting fixture 1. In FIG. 2, the static reflector-mounting strut 16 is rigidly affixed to the end caps 52 and 53. In the preferred embodiment, this rigid affixation is welded. It will be recognized that this rigid affixation may be accomplished by pop rivets, high strength tapes and adhesives and threaded fasteners. In addition, shown in FIG. 2 is the ballast cover 59, which covers the electronic ballasts, not shown, and provides access to the ballasts, housed in a ballast cavity, for installation and service. The ballasts are electrically connected to the lamps 2 and provide power suitable for starting and providing operating power to the lamps 2. In some configurations, it may be desirable to have one (1) ballast per lamp. However, it is preferred for cost and compactness to have one (1) ballast provide power to more than one lamp. In the preferred embodiment, a single ballast provides power to two lamps. FIGS. 1 and 2 show the lighting fixture configured as a four-lamp assembly. The lighting fixture is configurable in multiples of two lamps, i.e. two, four, and six lamps. It will be recognized by those skilled in the art that larger configurations are possible and that the present invention is not limited to the two, four, and six lamp configurations. Furthermore, the lighting fixture may be configured with an odd number of lamps wherein either a lamp cavity containing three lamps may be used or a single lamp may be placed within a lamp cavity having only one lamp. These cavities may be configured into lighting fixtures containing multiples of the single or triplet lamp cavities. Additionally, it may be desirable to configure a lighting fixture with a combination of odd and even lamped cavities.

Also shown in FIG. 2 are a pair of reflector hangers 60 and 62, which are fixably attached to a moveable reflector strut 61. In this design, the reflector hangers 60 and 62 are welded to the moveable reflector strut 61 to form a moveable reflector support assembly so that they act as a unit to support the reflector 4 and allow adjustment of the width of the illumination light field.

Figure 3:
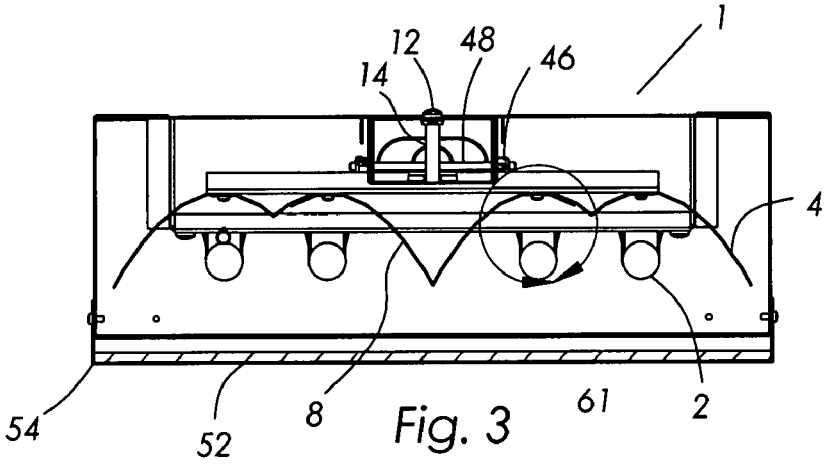
FIG. 3 is a section view showing the reflector position to yield the widest lighting field.
Figure 4:
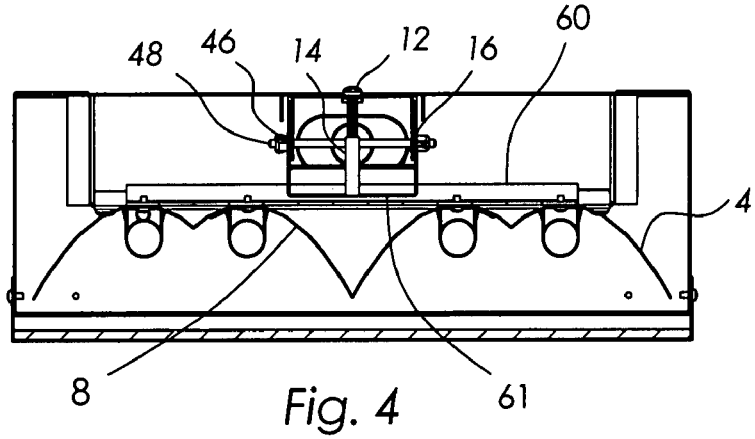
FIG. 4 is a section view showing the reflector position to yield the narrowest lighting field.

FIGS. 3 and 4 are Section Views taken at the illumination light field adjustment. FIG. 3 shows the reflector in the up or widest illumination light field position. As discussed earlier, the figures show a four-lamp configuration by way of example. The reflector 4 is designed to house a pair of lamps with the express purpose of creating a lighting fixture with a narrower width than a lighting fixture wherein each lamp has its own reflector cavity as commonly executed in prior art lighting fixtures. The reflector cavity 8 is designed as a pair of intersecting near parabolic shapes. The reflector cavity 8 is formed from a highly reflective material such as Miro IV by bending the Miro IV sheet metal in short flat lengths to create a faceted surface. These short bends are further shown in FIG. 5. The combination of the pair of intersecting near parabolic like shapes and the faceted surface creates an illumination light field that yields excellent lighting coverage and high efficiency of light output. Cavities are envisioned with a single near parabolic shape or as two or three intersecting near parabolic shapes.

Further shown, in FIGS. 3 and 4, are an illumination light field adjusting means, in the preferred embodiment, composed of an illumination field adjusting screw 12 and a mating sheet metal threaded standoff 14. FIG. 3 shows the reflector in the up or widest illumination light field position with the illumination field adjusting screw 12, bearing upon the upper surface of the static reflector mounting strut 16, threaded as far as the limit will allow into the mating sheet metal standoff 14, located in the lower surface of the moveable reflector support assembly. FIG. 4 shows the reflector in the down or narrowest illumination light field position with the illumination field adjusting screw 12 threaded as far as the limit will allow out of the mating sheet metal standoff 14. The up and down limit is controlled by a slot 50, shown in FIG. 11, in the static reflector mounting strut 16 shown in FIG. 2, the upper and lower ends of which provide limit stops. The adjustment mechanism further contains the pair of reflector hangers 60 and 62, which are fixably attached to a moveable reflector strut 61 wherein a hole is located in lateral alignment with the slot of the reflector mounting strut 16. The hole and slot are located on both sides of their respective channels. A threaded rod 48 is placed through the mating holes and slots and a wing nut 46 is threaded onto each end to lock the moveable reflector strut 61 and the reflector-mounting strut 16 together. The locked threaded rod also acts to provide for redundant safety. This adjustment feature is replicated at both ends of the lighting fixture 1.

Figure 5:
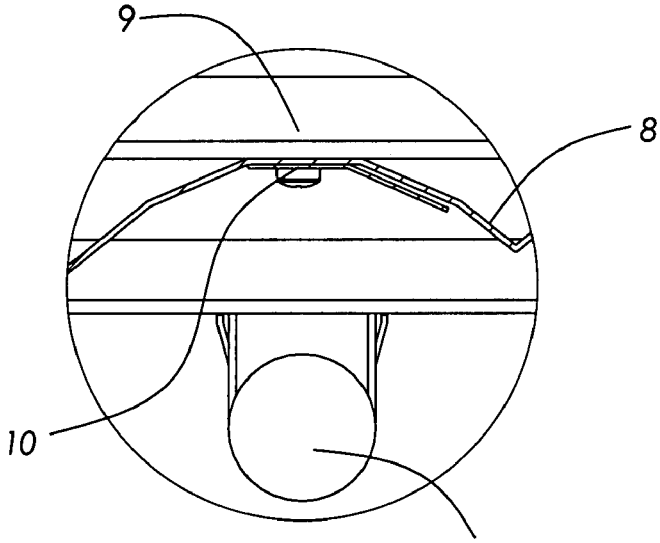
FIG. 5 is a detail view showing the aperture in the closed, downward reflective mode.
Figure 6:
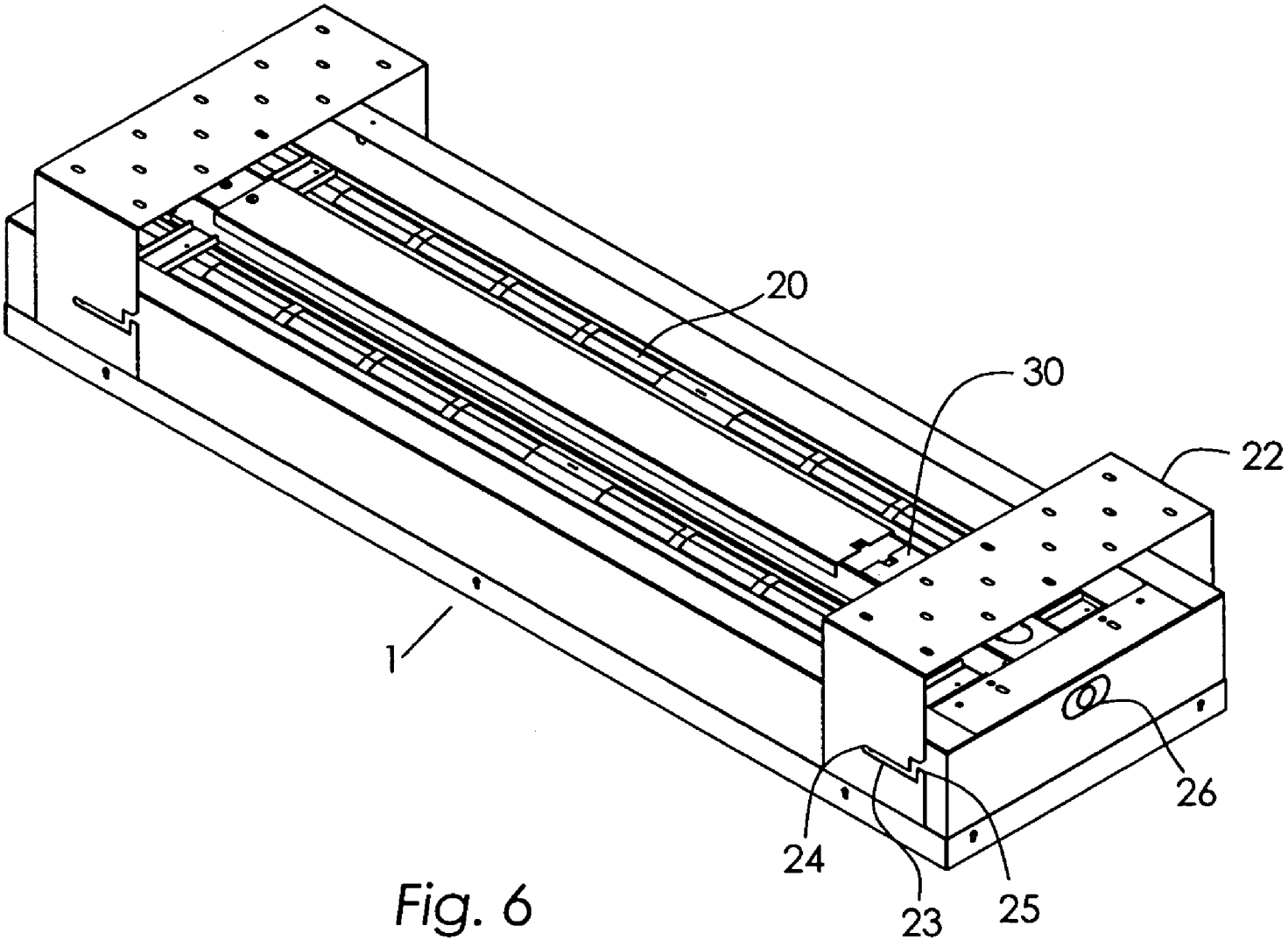
FIG. 6 is a perspective view showing surface mount hangers, covers and double knockout.

FIG. 5 is a detail view magnifying the relationship between an aperture 20, shown in FIG. 6, within the reflector 4 and the reflector cover 10. The reflector 4, which has aperture openings located at the apex of each parabolic like shape, shares mounting screws 9 with the aperture cover 10 at both ends. In the preferred embodiment, there are two mounting screws 9 for each aperture cover 10. The central position in the aperture cover 10 is secured with a finger spring 80 with its bent ends inserted into a slot 81, as shown in FIG. 9, located in the center of the aperture cover 10 to allow retention to the reflector 8 when the two endmost mounting screws 9 are removed. This allows the installer to easily reverse the aperture cover 10 as shown in FIG. 8 and hold it in place while reinstalling the two endmost mounting screws 9.

Figure 7:
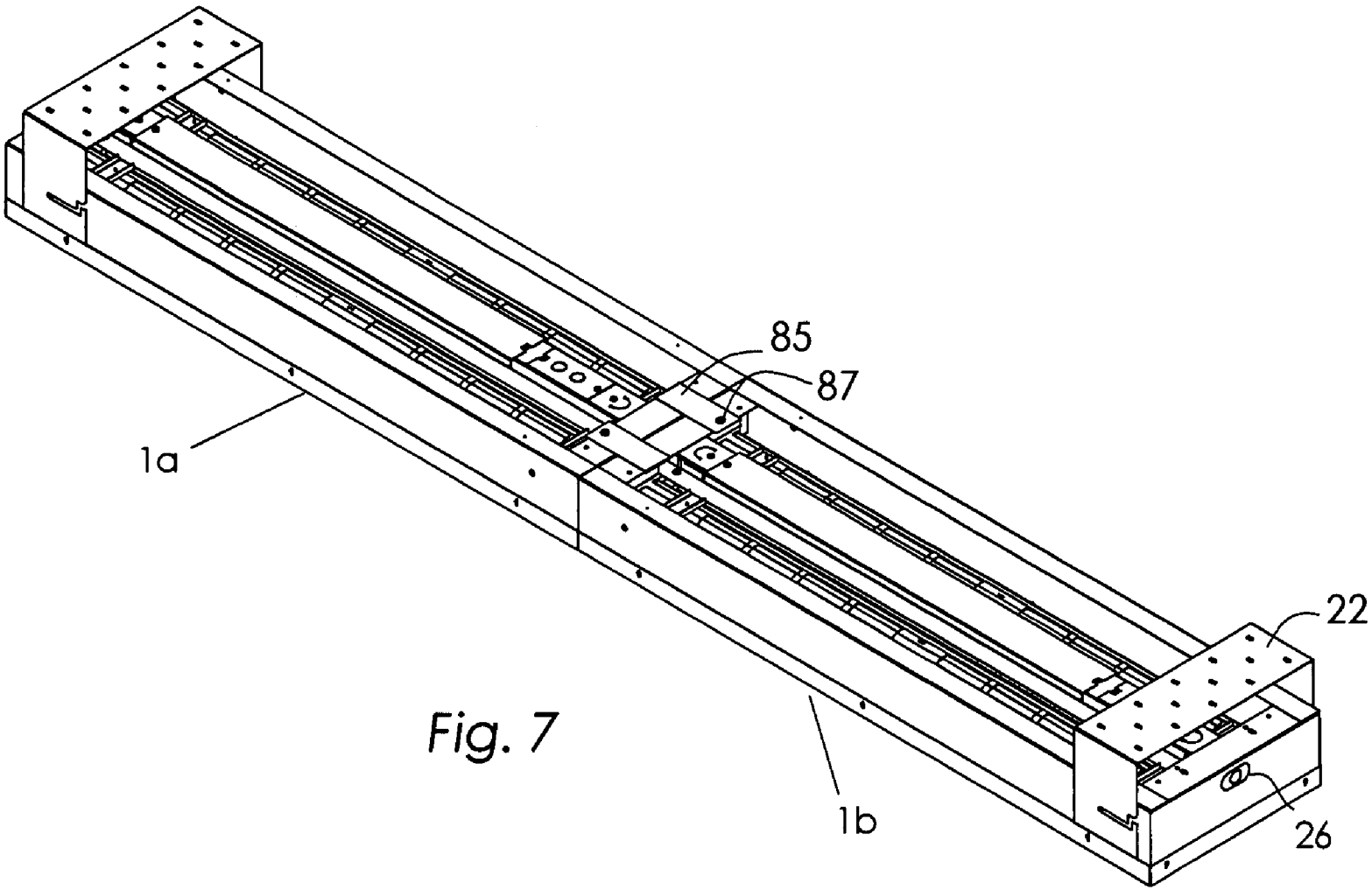
FIG. 7 is a perspective view showing two lighting fixtures mounted in a tandem configuration with surface mount brackets as an example.

FIG. 6 shows two surface mount hangers positioned in the mounted position. It will be noted by viewing FIG. 6 that the lighting fixture 1 sits in a pair of slots located in each surface mount bracket 22. The surface mount brackets 22 are spaced such that the fastening screw 24 is positioned, by way of example, at the extreme end of the slot in the leftmost surface mount bracket 22 in FIG. 6, while the fastening screw 24 is positioned away from the extreme end of the slot in the rightmost surface mount bracket 22. This allows the lighting fixture 1 to be slid to the right and lifted over the stop 25 to tilt the lighting fixture 1 downward for service or installation. FIG. 6 further shows a knockout feature 26 located on the end caps 52 and 53 to allow electrical connection between tandem mounted lighting fixtures as shown in FIG. 7. As shown, the knockout feature 26 is a dual knockout feature capable of being removed for a round or elongated access.

FIG. 7 shows the lighting fixture 1 mounted in a tandem configuration wherein surface mounting brackets 22 are shown as the means for hanging. Other mounting means may be used such as the chain and wire hanger shown in FIG. 10. The chain and wire hanger is composed of a wire hanger 40 and a chain 38. The lighting fixtures may be fastened together using the holes along the bottom of the end caps 52 and 53 along with the tandem mounting straps 85. In addition, the end caps 52 and 53 each have a knockout 26 for wiring interconnect between tandem-mounted lighting fixtures 1*a* and 1*b*. The knockout is a combination of elongated knockout and a round knockout. The appropriate section may be removed depending upon the wiring requirement.

Figure 8:
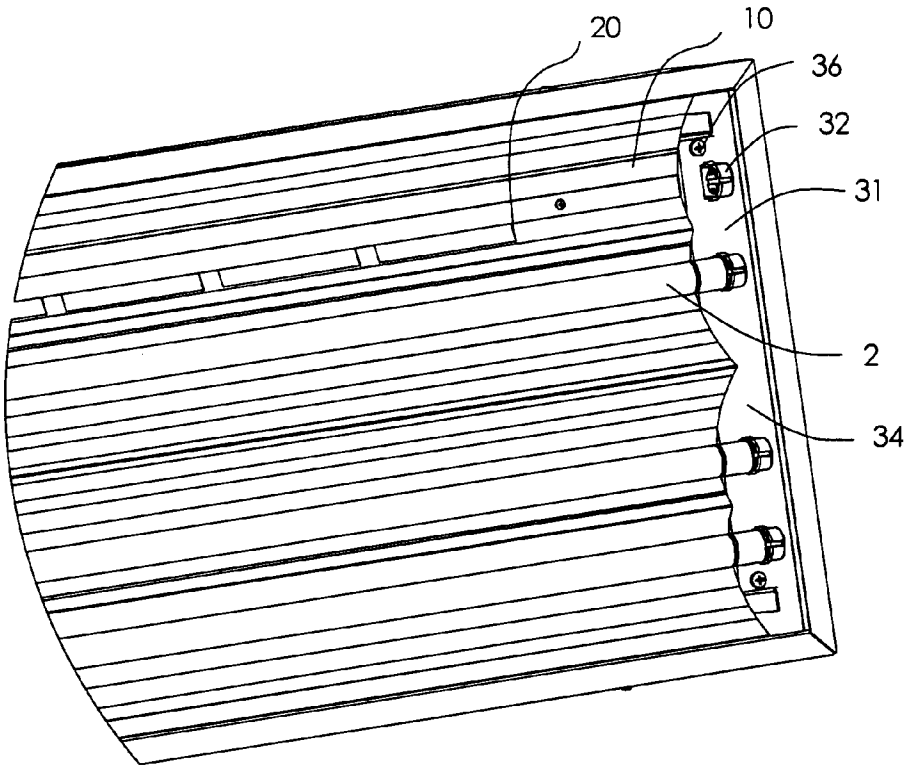
FIG. 8 is a detail view showing one aperture opened and a lamp removed for clarity to show the turned aperture.
Figure 9:
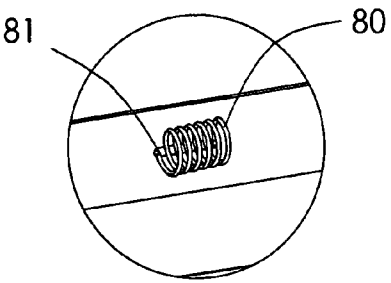
FIG. 9 is a detail view showing the spring retainer for the aperture cover.

FIG. 8 is a detail view, with one lamp removed for clarity, showing the aperture cover 10 reversed. There is one aperture cover 10 for each lamp 2. In the example used, there are four lamps 2. By reversing the aperture cover, one-half of the aperture openings 20 related to the individual fluorescent lamp is exposed. This allows light from the lamp to be directed upward towards the ceiling, which results in a portion of the available light to be indirectly directed toward the area where illumination is desired. The aperture cover 10 may also be completely removed thereby doubling the amount of light directed toward the ceiling and indirectly applied to the illumination area. One or more of the aperture covers 10 may be so reversed or removed to yield the desired lighting effect.

FIG. 8 also shows two screws 36, which affix the lamp socket and mount assembly 31 to the lighting fixture 1. The lamp socket and mount assembly 31 consists of a lamp socket mounting plate 34 and a plurality of lamp sockets 32 mounted to the lamp socket mounting plate 34. In the example illustrated, there are four lamp sockets 32 wherein the lamp sockets 32 are affixed to the mounting plate 34. The lamp sockets 32 are removable for replacement. The lamp socket and mount assembly 31 may be removed for access to the wiring without disassembly of the lighting fixture 1. There is one lamp socket and mount assembly 31 at each end of the lighting fixture 1.

FIG. 9 shows the finger spring 80 inserted into a coincident slot pair 81 located in the aperture cover 10 and the reflector 8. The finger spring 80 is a compression spring wherein a leg is bent outward along the longitudinal axis of the finger spring 80 on both ends in opposing direction. The finger spring 80 is inserted into the coincident slot pair 81 by compressing the spring with the fingers and inserting it into the coincident slot pair 81 and releasing the compression to complete the engagement process.

Figure 10:
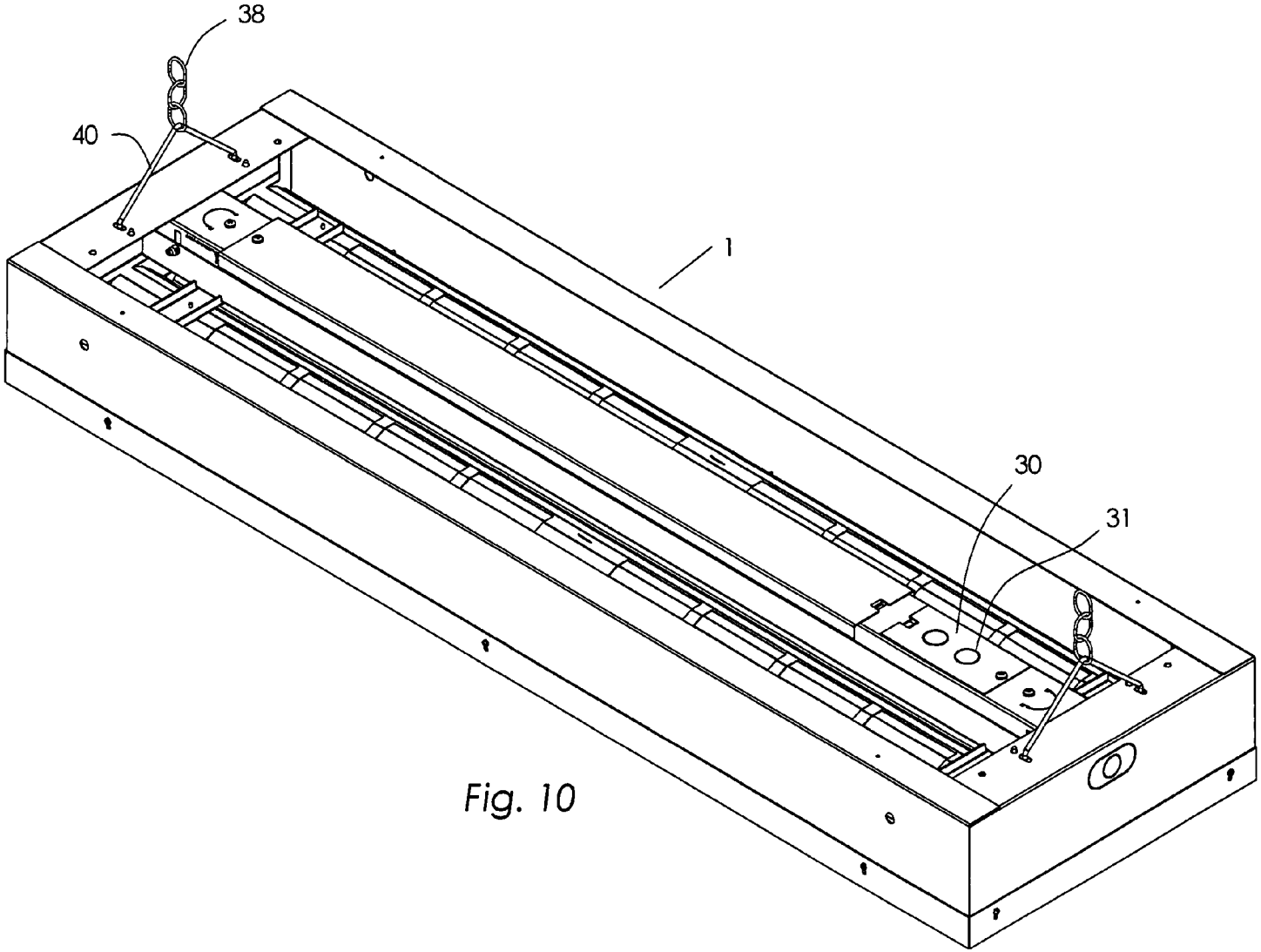
FIG. 10 is a perspective view to show chain hangers.

FIG. 10 shows the lighting fixture 1 having a means for hanging configured as a chain and wire hanger composed of the wire hanger 40 and chain 38. The chain and wire hangers are located at both ends of the lighting fixture 1. The wire hanger 40 along with the chain 38, superimposed thereon, is affixed to the lighting fixture 1 by tilting the hooked end of the wire hanger 40 into the slot 42 shown in FIG. 11 in the end caps 52 and 53 and rotating the ends of the wire hanger 40 into the round hole 44 adjacent to the slot in the end caps 52 and 53 as shown in FIG. 11.

Also shown in FIG. 10 is a quick connection plate 30, which contains at least one knockout 31 for connecting electrical power to the lighting fixture 1. The quick connection plate 30 may be removed to access the connections to the electronic ballasts.

Figure 11:
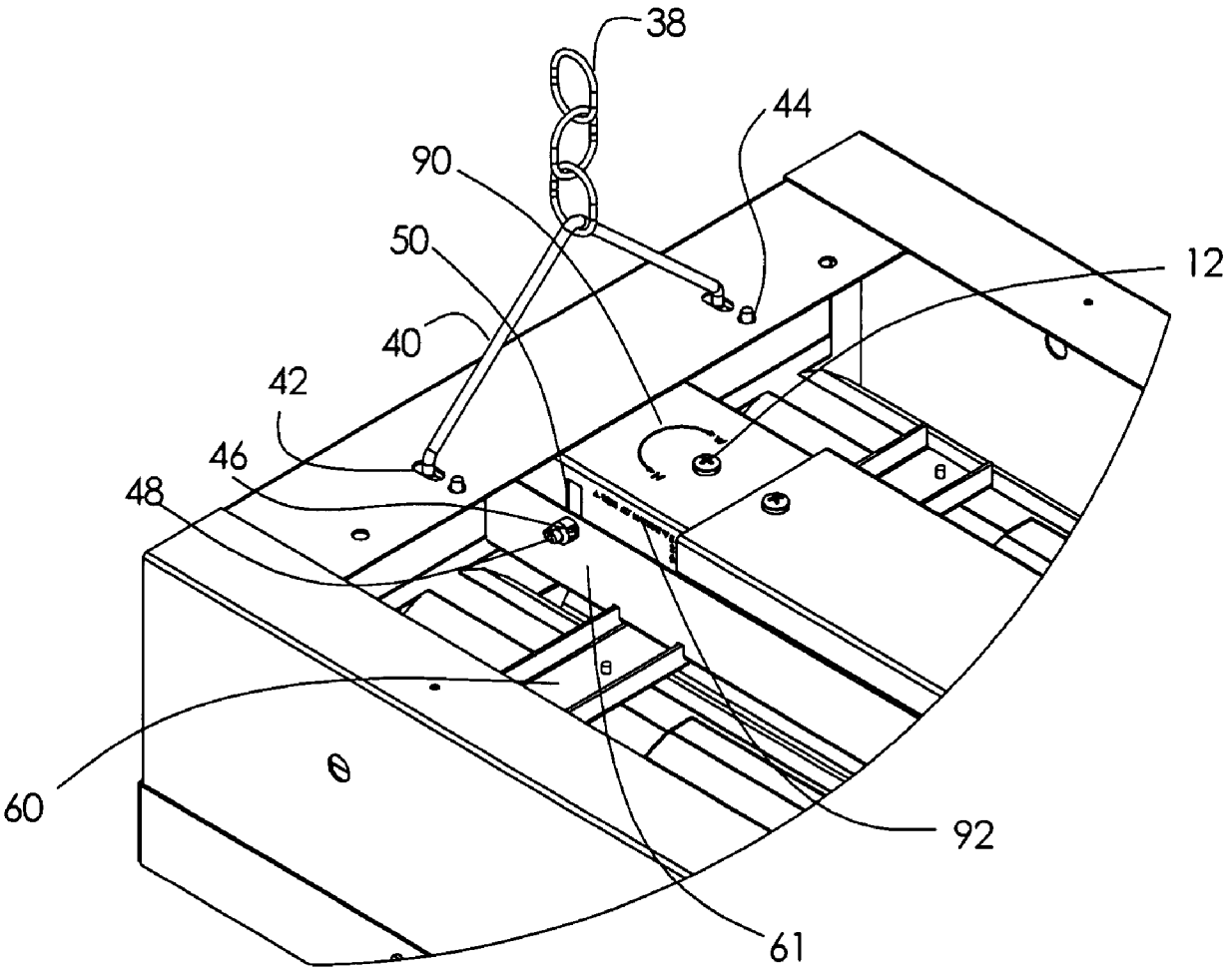
FIG. 11 is a partial perspective view to show the close-up of the chain hanger.

FIG. 11 shows a detail view wherein, the chain 38 and wire hanger 40, installation may be easily seen. Also shown are the details of the illumination light field adjustment. The features of the illumination field adjustment, as shown for clarity to include, the illumination field adjusting screw 12, the slot 50, the threaded rod 48, the wing nut 46, the reflector hanger 60, and the moveable reflector strut 61.

FIG. 11 further shows markings on the static reflector mounting strut 16, to aid in adjusting the illumination light field uniformly on both ends of the lighting fixture 1.

Figure 12:
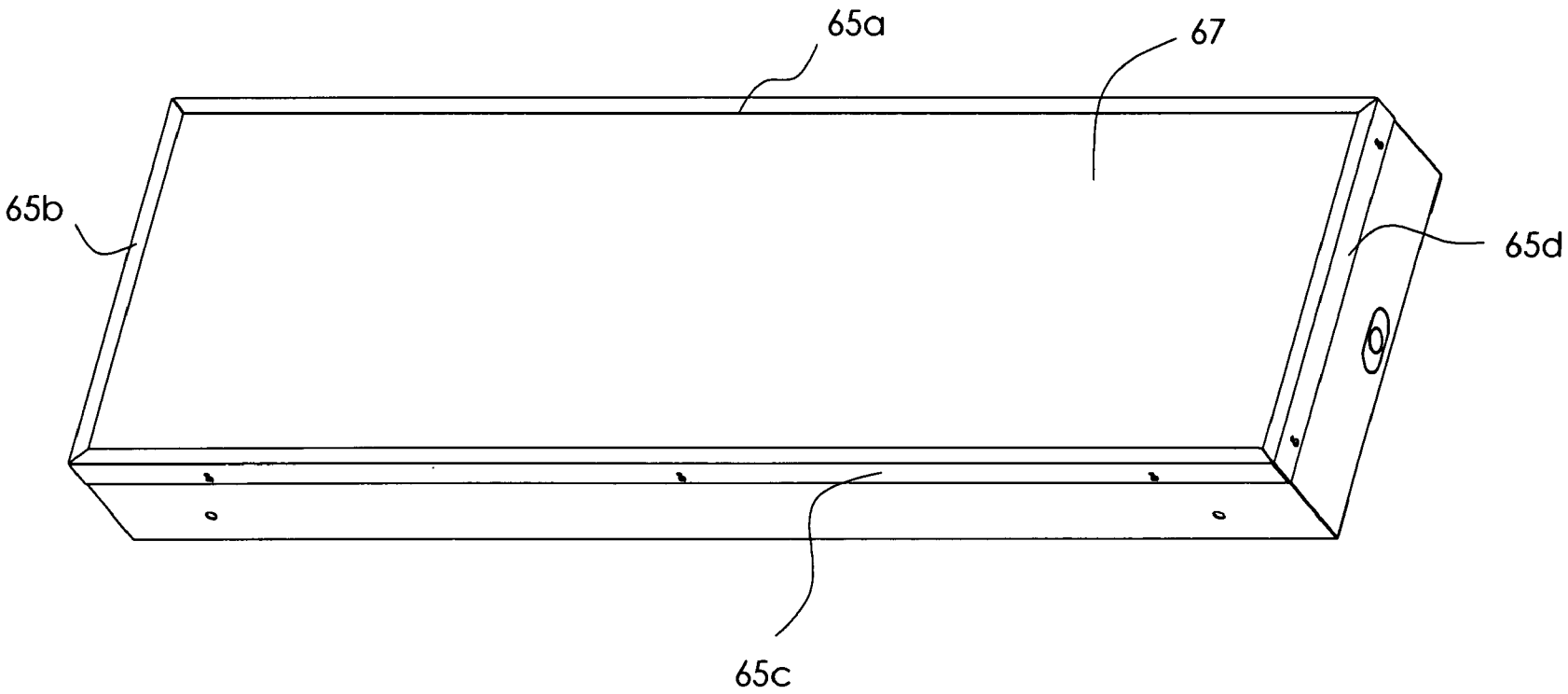
FIG. 12 shows the lighting fixture with the lens and lens mounting kit.

FIG. 12 shows the lighting fixture 1 with the lens attachment means 65*a*, 65*b*, 65*c*, 65*d* and lens 67 installed. The lens 67 is a generic term referring to any clear, diffusive, lenticular, or grill-like media placed in front of the fluorescent lamps to create a particular lighting or decorative effect as well as lamp protection. The bezel attachment means 65*a*, 65*b*, 65*c*, 65*d*, by way of example, is a series of retention components designed to retain the lens 67 to the lighting fixture.

FIG. 12 further shows adjustment markings 90 and 92 that aid the installer in adjusting the illumination light field between wide and narrow. These markings are at both ends of the lighting fixture 1 to facilitate the ease by which the installer achieves end-to-end uniformity of the illumination light field.

As will be obvious to persons skilled in the art, various modifications, adaptations, and variations of the specific disclosure can be made without departing from the teaching of the invention.

The invention claimed is:

1. A lighting fixture consisting of:

a) a lamp fixture housing;

b) a pair of lamp socket and mount assemblies each containing a plurality of lamp sockets having one lamp socket and mount assembly affixed to each end of said lamp fixture housing wherein one lamp socket from each of the pair of lamp socket and mount assemblies provides connection to each end of a fluorescent lamp;

c) a static reflector mounting strut rigidly and non moveably affixed to said lamp fixture housing;

d) a moveable reflector support assembly for mounting a reflector;

e) said reflector having at least one reflector cavity suitable for housing fluorescent lamps, wherein said reflector cavity is chosen from a group consisting of a single near parabolic like shape, a pair of intersecting near parabolic like shapes, or three intersecting near parabolic like shapes for creating an illumination light field with excellent lighting coverage and high efficiency light output, wherein each parabolic like shape houses a fluorescent lamp;

f) said intersecting near parabolic like shapes beneficially create a narrow lamp fixture housing;

g) said reflector mounted to said moveable support assembly is adjustably mounted to said reflector mounting strut wherein the moveable reflector support assembly is moved toward the fluorescent lamps to create a narrow illumination light field and away from the fluorescent lamps to create a wide illumination light field;

h) said illumination light field being adjusted by operating an illumination light field adjusting means;

i) at least one electronic ballast suitable for providing power for starting and operating at least one fluorescent lamp wherein said electronic ballast are housed in a ballast cavity within said lamp fixture housing to provide service and installation access to said electronic ballasts and a wiring thereof; and j) a means for hanging said lighting fixture.

2. The lighting fixture of claim 1, wherein said lamp fixture housing is constructed by rigidly affixing a pair of end caps to a pair of side rails.

3. The lighting fixture of claim 2 having a knockout feature to provide interconnect wiring between two lighting fixtures connected in tandem; said knockout feature being selected from the group consisting of a round or an elongated knockout feature.

4. The lighting fixture of claim 1, wherein said lamp socket and mount assemblies are easily removed for wiring access and replacement of individual lamp sockets.

5. The lighting fixture of claim 1 wherein said reflector cavity is created from a highly reflective material, formed in short flat lengths to create a faceted surface.

6. The lighting fixture of claim 1, wherein the distance between said reflector and said fluorescent lamp is adjusted by threading an illumination field adjusting screw, bearing upon an upper surface of said static reflector mounting strut, into a mating sheet metal threaded standoff in a lower surface of said moveable reflector support assembly; and said screw rotated in one direction raises said moveable reflector support assembly and said attached reflector away from the fluorescent lamp to create a wide illumination field and conversely is counter-rotated in the opposite direction to lower said moveable reflector support assembly and said attached reflector toward the fluorescent lamp to create a narrow illumination field.

7. The lighting fixture of claim 1 wherein said reflector cavities have aperture openings perforating each parabolic like shape at the apex of each parabolic like shape;

said aperture openings of said parabolic like shape is provided with an aperture cover configurably installed and chosen from the group consisting of the aperture cover covering the aperture opening, turned 180 degrees to partially expose the aperture opening, and totally removed wherein the configuration of said aperture cover apportions some of the emitted light from the fluorescent lamps upward to provide indirect illumination.

8. The lighting fixture of claim 1 wherein said lighting fixture has the means for hanging chosen from the group consisting of a "wire hanger and chain" and a surface mount bracket;

said means for hanging are used in pairs wherein one means for hanging is located proximate to each end of said lighting fixture.

9. The lighting fixture of claim 1 wherein said reflector mounting strut has markings to aid in adjusting the illumination light field uniformly on both ends.

10. A lighting fixture consisting of:

a) a lamp fixture housing;

b) a pair of lamp socket and mount assemblies each containing a plurality of lamp sockets having one lamp socket and mount assembly affixed to each end of said lamp fixture housing wherein one lamp socket from each pair of lamp socket and mount assemblies provides connection to each end of a fluorescent lamp;

c) a static reflector mounting strut rigidly and non moveably affixed to said lamp fixture housing;

d) a moveable reflector support assembly for mounting a reflector;

e) said reflector having at least one reflector cavity suitable for housing fluorescent lamps, wherein said reflector cavity is chosen from a group consisting of a single near parabolic like shape, a pair of intersecting near parabolic like shapes, or three intersecting near parabolic like shapes for creating an illumination light field with excellent lighting coverage and high efficiency light output, wherein each parabolic like shape houses a fluorescent lamp;

f) said intersecting near parabolic like shapes beneficially create a narrow lamp fixture housing;

g) said reflector mounted to said moveable support assembly is adjustably mounted to said reflector mounting strut wherein the moveable reflector support assembly is moved toward the fluorescent lamps to create a narrow illumination light field and away from the fluorescent lamps to create a wide illumination light field;

h) said illumination light field being adjusted by operating an illumination light field adjusting means;

i) at least one electronic ballast suitable for providing power for starting and operating at least one fluorescent lamp wherein said electronic ballast are housed in a ballast cavity within said lamp fixture housing to provide service and installation access to said electronic ballasts and a wiring thereof;

j) a means for hanging said lighting fixture; and k) a lens for providing lighting diffusion, protection, and decoration.

11. The lighting fixture of claim 10, wherein said lamp fixture housing is constructed by rigidly affixing a pair of end caps to a pair of side rails.

12. The lighting fixture of claim 10 having a knockout feature to provide interconnect wiring between two lighting fixtures connected in tandem; said knockout feature being selected from the group consisting of a round or an elongated knockout feature.

13. The lighting fixture of claim 10, wherein said lamp socket and mount assemblies are easily removed for wiring access and replacement of individual lamp sockets.

14. The lighting fixture of claim 9 wherein said reflector cavity is created from a highly reflective material, formed in short flat lengths to create a faceted surface.

15. The lighting fixture of claim 10, wherein the distance between said reflector and said fluorescent lamp is adjusted by threading an illumination field adjusting screw, bearing upon an upper surface of said static reflector mounting strut, into a mating threaded standoff in a lower surface of said moveable reflector support assembly; and said screw rotated in one direction raises said moveable reflector support assembly and said attached reflector away from the fluorescent lamp to create a wide illumination field and conversely is counter-rotated in the opposite direction to lower said moveable reflector support assembly and said attached reflector toward the fluorescent lamp to create a narrow illumination field.

16. The lighting fixture of claim 10 wherein said reflector cavities have aperture openings perforating each parabolic like shape at the apex of each parabolic like shape;

said aperture openings of said parabolic like shape is provided with an aperture cover configurably installed and chosen from the group consisting of the aperture cover covering the aperture opening, turned 180 degrees to partially expose the aperture opening, and totally removed wherein the configuration of said aperture cover apportions some of the emitted light from the fluorescent lamps upward to provide indirect illumination.

17. The lighting fixture of claim 10 wherein said lighting fixture has the means for hanging chosen from the group consisting of a "wire hanger and chain" and a surface mount bracket;

said means for hanging are used in pairs wherein one means for hanging is located proximate to each end of said lighting fixture.

18. The lighting fixture of claim 10, wherein said lens is chosen from the group consisting of clear, diffusive, lenticular, or grill-like media and said lens is retained to said lighting fixture by a lens attachment means.

19. The lighting fixture of claim 10 wherein said reflector mounting strut has markings to aid in adjusting the illumination light field uniformly on both ends.

* * * * *